United States Patent [19]

Golden

[11] Patent Number: 4,621,467

[45] Date of Patent: Nov. 11, 1986

[54] VERTICAL-WALLED EDGE-CONNECTED PANELIZED CONNECTABLE RHOMBIC TRIACONTAHEDRAL BUILDINGS

[75] Inventor: Frederick L. Golden, Ann Arbor, Mich.

[73] Assignee: Eric B. Lipson, Ann Arbor, Mich.

[21] Appl. No.: 469,226

[22] Filed: Feb. 24, 1983

[51] Int. Cl.[4] ..... E04B 1/32

[52] U.S. Cl. ..... 52/81; 52/309.9; 52/586; 52/DIG. 10

[58] Field of Search ..... 52/80, 81, 82, 86, 309.9, 52/586, DIG. 10

[56] References Cited

U.S. PATENT DOCUMENTS

| | | | |
|---|---|---|---|
| 3,192,671 | 7/1965 | Smith | 52/281 |
| 3,296,755 | 1/1967 | Chisholm | 52/81 |
| 3,722,153 | 3/1973 | Baer | 52/81 |
| 3,733,102 | 5/1973 | Serino | 52/309.9 |
| 3,953,949 | 5/1976 | O'Sheeran | 52/82 |
| 4,258,513 | 3/1981 | Bergman . | |

OTHER PUBLICATIONS

Zome Primer by Steve Baer ©1972, pp. 1-15.

Domebook II by Pacific Domes ©1971, pp. 12, 92, 93, 102, 103.

*Primary Examiner*—Henry E. Raduazo

*Attorney, Agent, or Firm*—James M. Deimen

[57] ABSTRACT

A building system or combination of building structures which comprise panelized edge connected elongated rhombic triacontahedral structures for the roofs and walls, the walls being elongated vertical panels. The structures include hollow extruded connectors for joining the panels together and in some instances for joining the building structures together as a single unit. Externally the connectors are relieved to provide a flush surface appearance with the panels. The hollow connectors create strong lightweight structures with integral conduits for utilities. Tie downs to retain the structures in place can be threaded through the hollow connectors.

One important optional feature is a foundation provided by vertical panels partially buried in the ground. This option provides a substantial improvement in the control of heat loss from the structures at minimum cost. Another feature comprises optional alcoves creating a roof treatment minimizing the dome like appearance of the structures and substantially increasing the open interior floor space. The alcoves and roof treatments utilize inverted connectors to form concave sections of the roof and exterior walls of the structures.

20 Claims, 21 Drawing Figures

FIG. 4
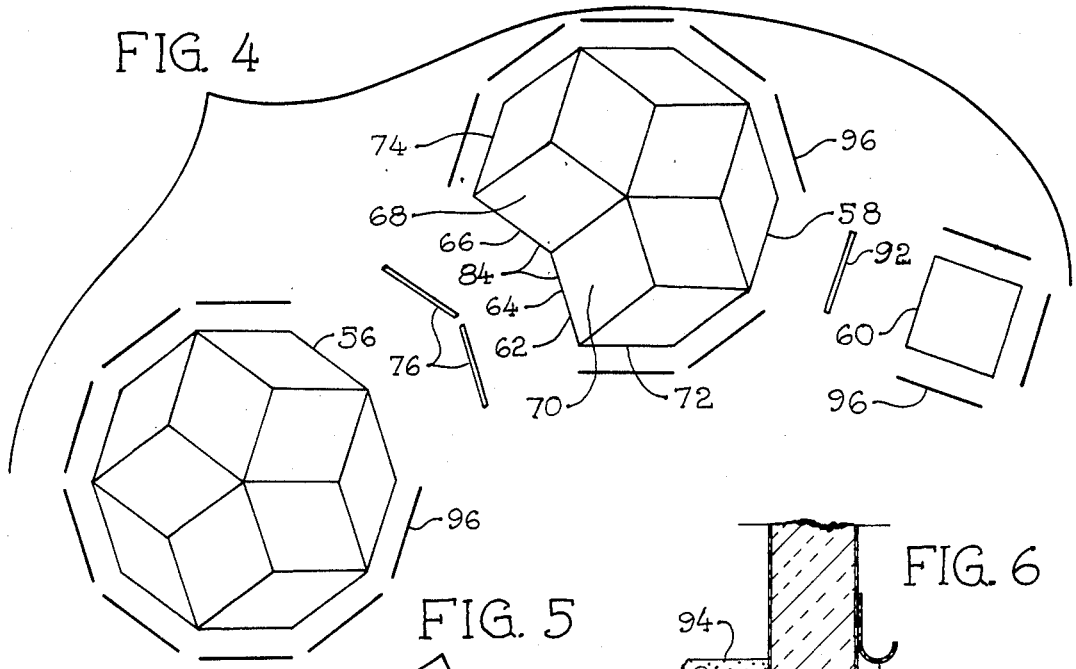
FIG. 5
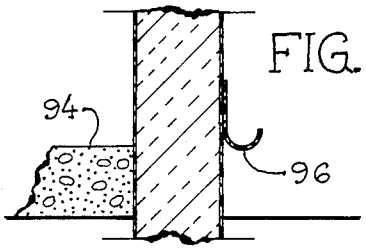
FIG. 6
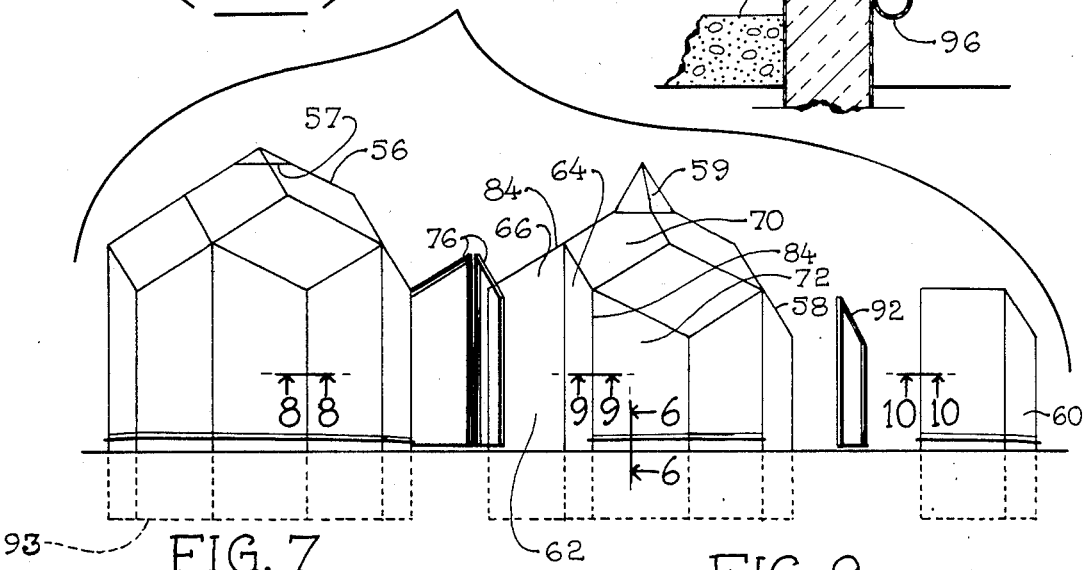
FIG. 7
FIG. 9
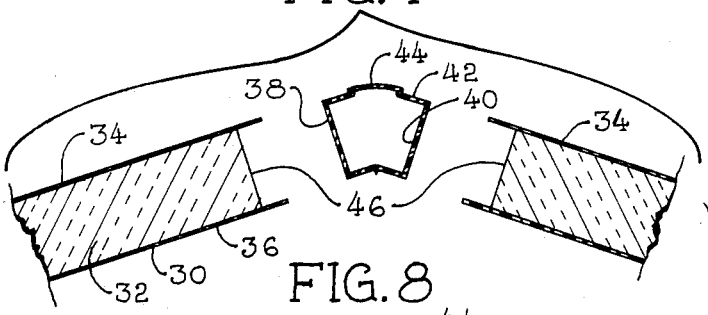
FIG. 8
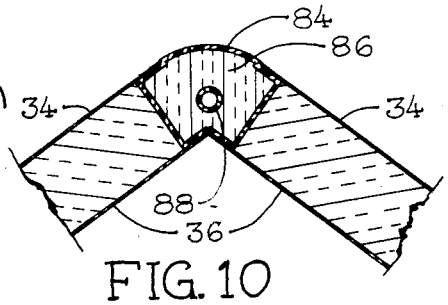
FIG. 10
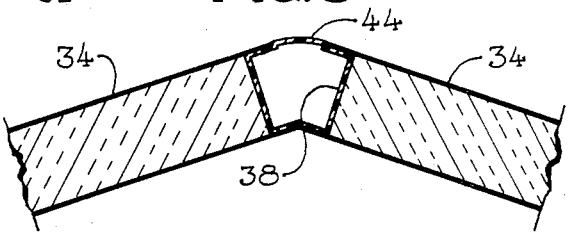
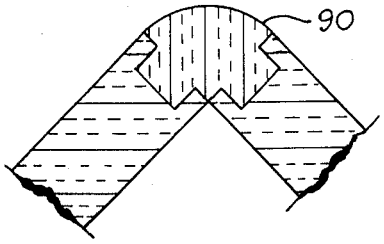

VERTICAL-WALLED EDGE-CONNECTED PANELIZED CONNECTABLE RHOMBIC TRIACONTAHEDRAL BUILDINGS

BACKGROUND OF THE INVENTION

1. Field of the Invention

The invention relates to self-supporting, insulated single story enclosures used for housing, emergency shelter, work camps, rapidly deployable military structures, utility buildings, vacation homes and primary housing. More specifically, the invention pertains to panelized, edge-connected structural building systems that are rapidly and easily erectable with a minimum of labor and without electricity or special tools.

2. Prior Art

The goal of designing strong yet light weight structural enclosures that are easy to assemble and disassemble, insulated, weatherproof, easy to manufacture and economical has been the goal of many inventors. The optimum design should be a totally integrated system with an absolute minimum of differing parts which are simple, if not foolproof, to assemble together in a short period of time by a few inexperienced persons with no special tools or electricity. Thus, the aim has been to simplify the structural enclosures in every way, from manufacture of the components through erection of the enclosure.

U.S. Pat. No. 4,263,758 to Seaich discloses geodesic dome structures comprising 44 separate plywood panels arranged at 5 different angles to each other and mounted on a framework of beams each beveled at one of the 5 different angles. Similarly, U.S. Pat. No. 4,048,770 illustrates a structure comprised of fifteen identical equilateral triangular panels forming fifteen twentieths of an icosahedron. The panels are bolted onto a wooden frame, the frame being bevel-cut and bolted together.

U.S. Pat. No. 3,640,034 to Shotwell, Jr. discloses panels of rigid sheets arranged in a 15 sided polyhedron, the panels being connected along the panel edges with tape. Similarly, U.S. Pat. No. 3,445,970 illustrates structures constructed of right triangular rigid sheets taped together. Another example of a tape connected structure is disclosed in U.S. Pat. No. 2,982,290 wherein a hemisphere of thirty curved triangular segments are connected by a tape described as a "flexible" material.

U.S. Pat. No. 4,009,543 to Smrt discloses a geodesic dome comprised of a plurality of triangles formed by hollow struts. The triangles thus formed are joined together at the hubs by sheet metal flanges bolted together. The structure is covered by triangular sheets secured to the struts.

In the foreign art, Danish Pat. No. 82614 discloses a sloping sided dome formed with transparent panels on a frame. A more complex design is demonstrated by French Pat. No. 2,225,586 disclosing a multitude of polyhedra created by an intricate system of many separate parts in an arrangement of hubs, struts and panels.

None of the above noted patents discloses a fully integrated panel and connector system that is easy to assemble into a finished structural enclosure, inexpensive to manufacture but nevertheless weatherproof, insulated, lightweight and sufficiently strong to be considered as permanent or semi-permanent. U.S Pat. No. 3,292,316 to Zeinetz discloses a domed self-supporting panelized roof system including a hollow connector, however, no means for integrating a wall structure or additional domes thereto is disclosed. In general the prior art discloses either excessively complicated structure of sometimes questionable weather-tightness or relatively weak and fragile structures of panels joined by adhesive tape. Chronic water and air leaks have been a major drawback to many otherwise structurally sound building systems.

Synapse, Inc. of Lander, Wyo. discloses on page 104 of Domebuilders Handbook II a vertical walled rhombic triacontahedral structure available as a prefabricated kit. The structural system is apparently bevel-edged plywood exterior panels bolted to a 2×4 wooden frame. Similarly, Steve Baer of Albequerque, N.M. has reportedly built rhombic triacontahedral structures called Zomes. Zomes do not utilize an integrated panel and connector system, or concave nesting modules.

The prior art known to applicant fails to disclose a completely integrated panel and edge connector system incorporated into an efficiently designed structure complete with foundation. Such a structure should be weatherproof, insulated, easy to manufacture and to erect, interconnectable with similarly shaped structures and alcoves, and adaptable to the full range of uses from temporary storage buildings to permanent housing.

SUMMARY OF THE INVENTION

The invention comprises a building system or combination of building structures of panelized edge-connected elongated rhombic triacontahedral structures for the roofs and walls, the walls being elongated vertical panels. The structures include hollow extruded connectors for joining the panels together and for joining the building structures together as a single unit. Externally the connectors are relieved to provide a flush surface appearance with the panels. The structures are derived from the geometric solid defined as a rhombic triacontahedron.

The hollow connectors and the panels create strong lightweight structures with integral conduits for utilities. Tie downs to prevent storm damage and retain the structures in place can be threaded through the hollow connectors.

One important optional feature is a foundation provided by vertical panels partially buried in the ground. This option provides a substantial improvement in the control of heat loss from the structures at minimum cost. Another feature comprises optional alcoves creating a roof treatment that minimizes the dome like appearance of the structures.

It is an object of the building system to provide structural components, weatherproofing, insulation, foundation, frame and interior walls in two basic components: rigid panels and hollow substantially rigid edge connectors.

It is a further object to provide structures using applicant's panel and connector system which can be assembled and disassembled in a minimum of time with a small crew and no special tools or power tools.

It is another object to provide structures with a multiplicity of uses including but not limited to backyard storage sheds, disaster relief shelters, military field structures, work camp facilities, vacation homes and primary housing. The building system creates interconnectable room-sized units which can be connected in a multiplicity of configurations with a minimum total quantity of materials required for the complete structure.

Another object of the building system is to provide not only waterproof well insulated structures but also exceptionally wind resistant and earthquake resistant structures, this being accomplished by light weight components combined with the great strength inherent in the completed geometry of the structures.

The components can be manufactured very economically because both the panels and the connectors can be extruded continuously and simply cut to length and shape with nominal waste. Alternatively, the panels can be separate extrusions laminated together to form solid surface foam filled panels.

The completed structures lend themselves to potential solar gain benefits. The integrated insulated foundation and a concrete or tile interior floor can be advantageously combined with transparent panels to create a very effective passive solar effect.

A very important object of the building system is to provide a structure with vertical walls so as to allow the use of standard doors and windows and to create a more comfortable and useful interior than is created by domed structures with curved or sloping side walls. The vertical walls also permit the use of concave wall sections to provide the nesting of dome modules together despite dissimilar wall heights.

DESCRIPTION OF THE DRAWINGS

FIG. 4 is an exploded plan view of adjacent structures;

FIG. 5 is an exploded elevation of the adjacent structures shown in FIG. 4;

FIG. 6 is a partial vertical section of a vertical panel at ground level taken along the line 6—6 in FIG. 5;

FIG. 7 is an exploded partial section of panels joined by a 144° connector;

FIG. 8 is a partial section of panels joined by a 144° connector taken along the line 8—8 in FIG. 5;

FIG. 9 is a partial section of panels joined by a 108° connector taken along the line 9—9 in FIG. 5;

FIG. 10 is a partial section of panels joined by a 90° connector taken along the line 10—10 in FIG. 5;

DESCRIPTION OF THE PREFERRED EMBODIMENTS

Figure 1:
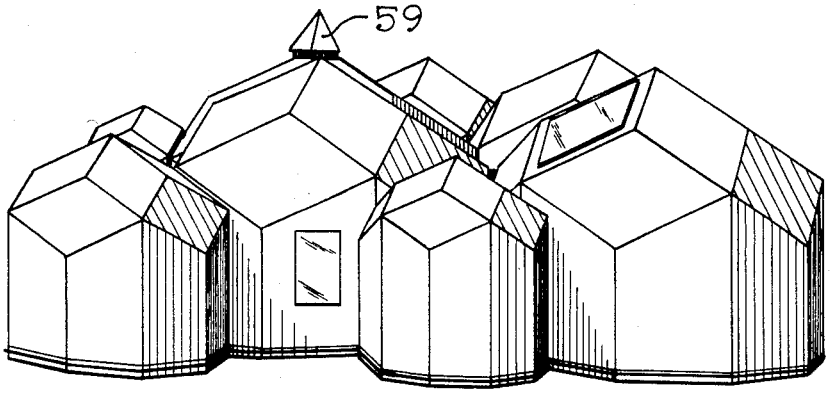
FIG. 1 is a perspective view of a cluster or combination of building structures taken from the direction of arrow 1, in FIG. 2.
Figure 2:
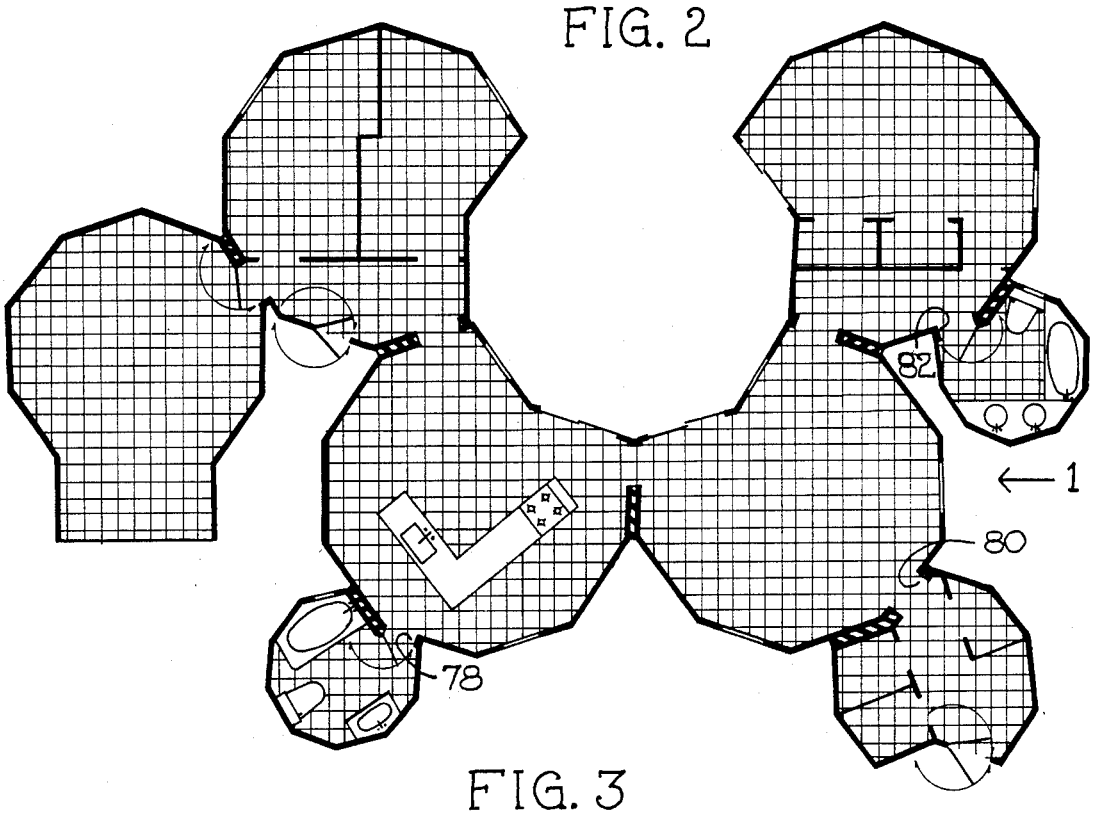
FIG. 2 is a floor plan of the complete building shown in FIG. 1.

FIGS. 1 and 2 illustrate a typical example of the almost infinite variety of floor plans and elevational appearances that can be created with vertical walled elongated triacontahedral structures or modules clustered together to form a building. In this example four dome modules are clustered about an atrium or courtyard with domes of smaller diameter attached about the periphery to provide two bathrooms, an entranceway and garage. This example is selected to illustrate a structure combining panels of six foot, five foot, four foot and three foot widths to provide rooms of appropriate size for their purposes.

Figure 3:
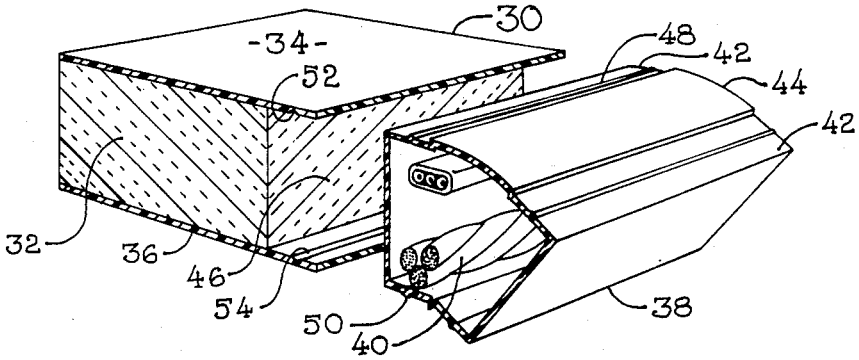
FIG. 3 is an exploded perspective view of a typical section of panel and connector at the juncture therebetween.

In FIGS. 3, 7 and 8 the basic panel and 144° connector configuration is illustrated. A single complete dome with vertical walls can be constructed with only these two basic panels and connectors cut to size and length. The panel 30 preferably comprises a plastic foam core 32 with hard surface layers on both sides 34 and 36 to protect the core. The connector 38 is hollow to permit utilities 40 to be strung through the connectors upon completion of the structure. The connectors 38 are relieved at 42 to form a cap 44 such that the relief is equal to the thickness of the hard surfaces 34 of the panels. The foam 32 is also relieved to provide a channel 46 into which the connector can be inserted.

A variety of means to retain the connectors 38 in the panel channels 46 can be used depending upon the intended permanence of the building, water and windtightness of the building and the skill of the assembly crew. Illustrated is a snap together configuration suitable for both temporary and permanent assembly. An integral longitudinal locking ridge 48 is provided in the relieved portion 42 of the connector and a second ridge 50 on the opposite side of the connector 38. The ridges 48 and 50 are adapted to engage the grooves 52 and 54 formed in the extended hard surfaces 34 and 36 of the panel. The panels and connectors can thereby be easily snapped together and easily pried apart for disassembly.

More permanent assembly can be provided with compatible adhesives or glues applied as the connectors and panels are snapped together. Also, the ridges and grooves can be deleted as shown in FIGS. 7 and 8 and the panels and connectors affixed with the adhesives only. Where electric power is available, the panels and connectors can be joined with hot melt glues or by electronic or ultrasonic welding methods.

The particular means of joining the panels to the connectors depends upon the particular plastic materials used to construct the panels. Other choices for the panels can include honeycomb or corrugated forms in substitution for the foam 32. Plywood and other materials may also be substituted for the foam interior, however, the extended hard plastic surfaces 34 and 36 are required for joining to the connectors as illustrated and are suitable as exterior surface treatments without additional covering if suitable plastics are selected.

The foam core and hard plastic surface layers provide the preferred combination for a variety of reasons. The foam core provides a lightweight combination of compressive strength and insulation. The hard plastic surface sheeting or layer on the exterior and interior of the panels provides weatherproofing, tensile and lateral compressive strength to the panels. This is in addition to the channel edges for joining to the connectors.

The connectors are best made as plastic extrusions of the same or a plastic compatible with the panel surface sheeting. The cap 44 provides a flush surface with the surface sheeting for a finished appearance without additional treatment.

The left most dome module 56 illustrated in FIGS. 4 and 5 with the exception of the gutters can be completely constructed merely with the panels and 144° connectors above. With the panels and connectors manufactured to size and length, unskilled workers can quickly assemble the dome module with a minimum of direction.

This basic structure comprises twenty panels connected by thirty-five 144° edge connectors. All panels may be formed from the same width extrusion as described below. Two types of panels for the basic structure or module 56 are required: ten identical rhombic roof panels and ten identical wall panels square cut at the bottom. The wall panels are assembled with appropriate length connectors into a ten-sided ring by joining long vertical edges together and short vertical edges together.

The roof comprises two concentric rows of five panels each as best shown in FIG. 4. The outer or roof base panels mount atop the wall ring filling the valleys created by the short panel edges of the wall ring. The five roof peak panels extend from the peak of the dome to peaks formed by the long panel edges of the wall ring to complete the dome. Since all the dihedral angles of the module are 144°, all the connectors for the basic structure are 144°.

To construct the basic structure, the roof peak panels are assembled first and then the roof base panels added to the peak assembly. This assembly can then be placed atop the vertical wall ring because all exposed edge connectors attached to the roof assembly are oriented vertically.

Alternatively, a portion of the peak of the dome may be cut-away at 57 for a ventilating cupola 59 as shown in FIGS. 1 and 5. Such a cut-away permits assembly of the roof upwardly from the wall ring by adding the roof base panels and then the peak panels. The final two connectors for the peak panels are slideably inserted after the final panel is in place.

The complete structure of FIGS. 4 and 5 includes a second dome module 58 and square alcove 60. To provide a concave portion 62 of the vertical side wall of dome 58, a 108° connector 84 as shown in FIG. 9 is required at the junctures of the "concave" panels 64 and 66 with the roof panels 68 and 70 and the wall panels 72 and 74. As further explained below panels 64 and 66 will be slightly smaller in width than the other panels depending upon panel thickness. As is apparent from FIG. 5 the modules need not be of identical height or even size as illustrated in FIG. 2. Gaskets 76 to flexibly weatherproof the interface between the modules are provided as an option. Openings for doors such as illustrated in FIG. 2 at 78, 80 and 82 may be provided through the facing common panels of each dome.

The 108° connector 84 can be formed hollow or partially foam filled 86 with a small conduit 88 therewithin. Such a connector 84 adds additional structural strength and insulation to the building. The foam can also be added by foaming in place after the structure is complete with the utilities in place in the connectors.

A small alcove or closet 60 can be constructed using the panels and a 90° connector 90 as illustrated in FIG. 10. The alcove 60 is fitted against a single common panel of dome 58 with an expansion gasket 92. This single common wall connection also allows the dome modules to be connected to conventional vertical walled buildings. FIG. 10 illustrates the use of self skinning structural foam plastic for both the panels and the connector.

FIGS. 4, 5 and 6 also illustrate the very simple combined foundation and wall structure. Because the modules are of lightweight materials, a very effective foundation for both supporting the structure and preventing movement thereof can be created by using vertical wall panels that are long enough to extend below grade as indicated at 93. Before the wall ring is assembled, a circular or peripheral trench of sufficient depth is dug. The wall ring is then assembled therein. The roof is completed to bring the module to full strength and rigidity before the trench is backfilled.

A floor 94 of concrete, tile or other material can be placed inside the module as shown in FIG. 6. A low peripheral gutter 96 is installed to carry water to a common drain (not shown) away from the walls of the structure. The gutters 96 are simple plastic extrusions adhesively or otherwise affixed to the panels subsequent to assembly. A completely tight insulated peripheral foundation for each module is thereby created to provide excellent energy control and effectiveness. Combined with the masonry or concrete floor 94 and appropriately glazed panels in the wall and roof, excellent passive solar heating and heat retention is built into the structure at nominal extra cost. As shown in FIG. 5 concrete footings and a masonry foundation are unnecessary because the very light foam panel and connector construction produces ground loads only a small fraction of the ground loads of conventional construction. Under conditions of exceptionally loose soil or sand, footings can be placed in the trench to support the structure.

Figure 13:
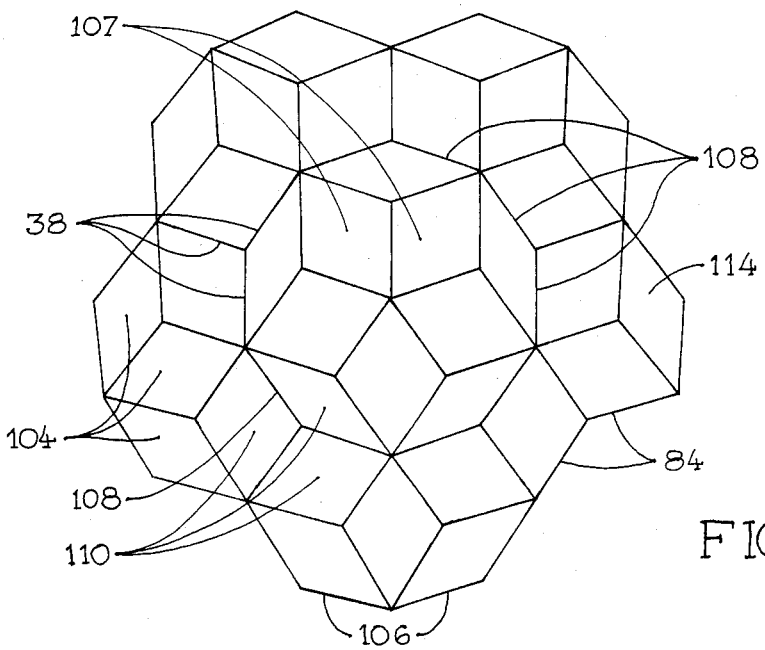
FIG. 13 is a plan view of an alcove extended structure.
Figure 14:
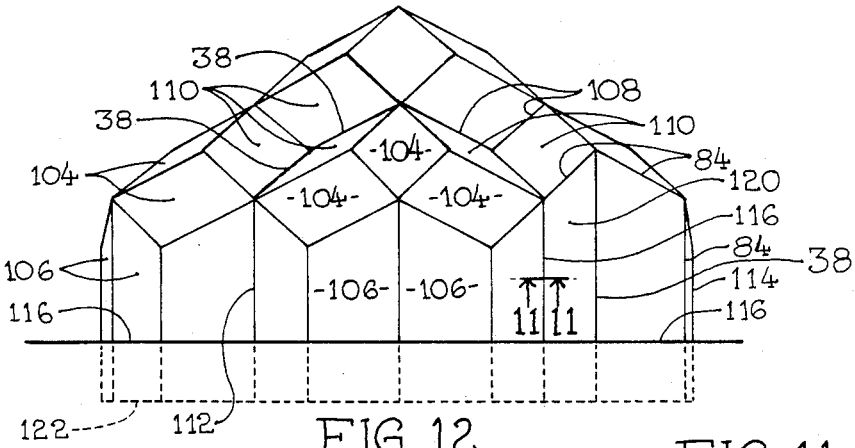
FIG. 14 is an elevation of the structure shown in FIG. 13.
Figure 11:
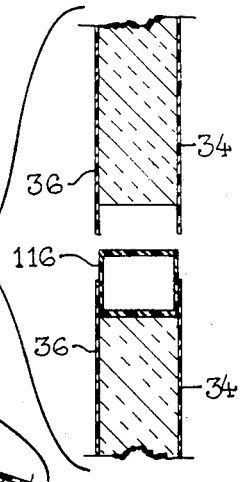
FIG. 11 illustrates a 180° panel connector and panels in exploded partial section taken along the line 11—11 in FIG. 14.
Figure 12:
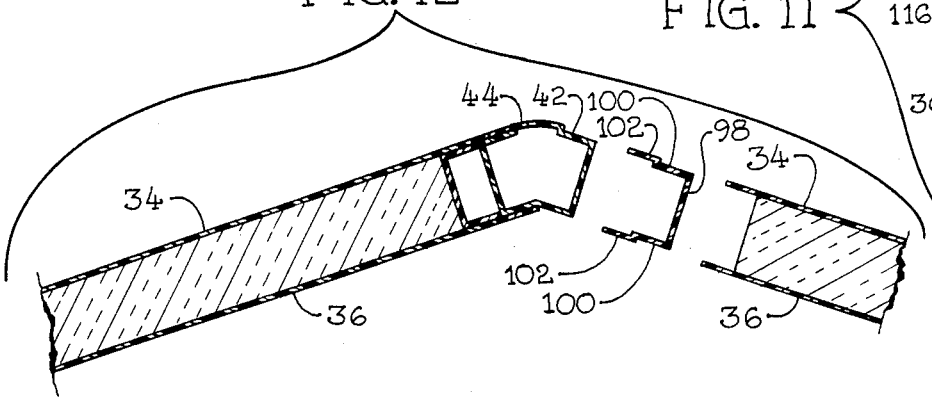
FIG. 12 illustrates a panel extender combined with a connector and panels in exploded partial section.

In FIGS. 11 and 12 additional connectors are illustrated. Their use in an extended or multiple alcove dome module is illustrated in FIGS. 13 and 14. The module of FIGS. 13 and 14 is substantially twice the diameter of the same module without the extended alcoves. As explained below slightly larger panels provided by the channel extension 98 illustrated in FIG. 12 are required for the convex portions of the alcove dome module. The extensions 98 are preferably of the same material as the connectors and are relieved at 100 to form a cap 102 that fits over the relieved portion 42 of the connector. The extensions are required for the roof 104 and wall 106 panels forming the convex portions of the alcoves that extend about the periphery of the structure.

FIGS. 13 and 14 illustrate a novel "concave" roof treatment of the alcove extended dome. Roof panels 110, that are joined with an inverted 144° connector 38 above a vertical connector 112 between alcoves, are depressed although sufficiently tilted radially to prevent the collection of rain water. This roof treatment breaks up the dome like appearance of the basic structure. For a given size of panel the structure of FIGS. 13 and 14 creates an enclosure with a clear span diameter substantially twice that of the basic dome module 56 shown in FIGS. 4 and 5. The depressed roof panels 110 are slightly smaller relative to the remaining roof panels 104 over the alcoves and 107 of the innermost roof ring. Panels 110 are therefore assembled without the extensions 98. The complete structure of FIGS. 13 and 14 can be assembled with panels of a single width, the extenders 98 being used for those panels that cover convex portions of the roof and alcoves. Alternatively, smaller panels for the concave roof panels 110 and alcove panels 111 can be manufactured as explained below with respect to FIG. 15. The smaller panels eliminate the need for the channel connectors 98.

The 144° connectors 38 about the inner dome periphery 108 are inserted to accommodate the depressed panels 110 but otherwise identical. Thus, the extended dome module can be constructed with three basic parts, panels, 144° connectors 38 and extensions 98. The easiest mode of assembly for the roof is again to begin at the peak and assemble outwardly to the wall ring. The module of FIGS. 13 and 14 can be nested with the modules of FIGS. 4 and 5 in the same manner as described above because of the basic 144° dihedral angle between the wall panels of the alcoves.

The differences in sizes of the roof panels and wall panels of the alcove extended dome arise from the thickness of the panels and the inversion of the connectors in the concave roof and wall portions. Thus, the channel depth of the connectors 98 is determined by the thickness of the panels. Thicker panels require deeper channels or a greater difference in panel size between those panels used for convex portions of the structure and those panels used for concave portions of the structure.

Although all of the alcoves may be identical, FIGS. 13 and 14 illustrate a smaller alcove 114 as an option. This option utilizes the straight (180°) connector 116 of FIG. 11 for the connection of vertical panels 118 and 120 and the 108° connectors 84 at the roof line or eave. The straight connector 116 has a second optional use, that being to extend the vertical height of the vertical panels where a separate panelized foundation ring 122 is utilized. Thus, at or slightly above ground level the straight connectors 116 can be used to connect a foundation ring 122 to the vertical wall panels thereabove.

Figure 15:
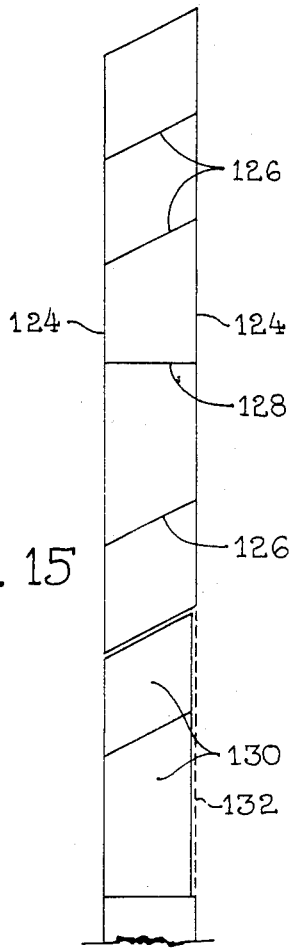
FIG. 15 schematically illustrates substantially wastage free manufacture of the panels.

FIG. 15 illustrates schematically the extrusion of panels either as a co-extrusion or laminated composite produced as a continuous sheet form with the panel width desired. The edges 124 of the continuous form are relieved between the top and bottom surfaces to provide the channels 46 as illustrated in FIG. 7. The continuous form is merely sliced on the bias as at 126 to form the rhombic roof panels or perpendicular 128 at the appropriate lengths to form the vertical wall panels. The slicing is preferably done by a shaped rotary cutter to simultaneously form the channels 46 in the sliced edges. The perpendicular bottom edges of wall panels, however, can be straight cut if no 180° connector 116 is to be thereattached. For panels 130 of slightly narrower width such as required for the alcove extended dome, the sheet form can be trimmed and channelled as indicated by the dashed line 132 in FIG. 15.

Because of the raised cap 44 on the connector only a thin seam is visible where connector and panel join. Care must be taken during assembly to properly trim and join the connectors at the vertices. Although the strength of the structure is not dependent upon the vertex joints, the wind and water tightness of the structure are dependent on proper trimming and sealing of the vertices.

Figure 16:
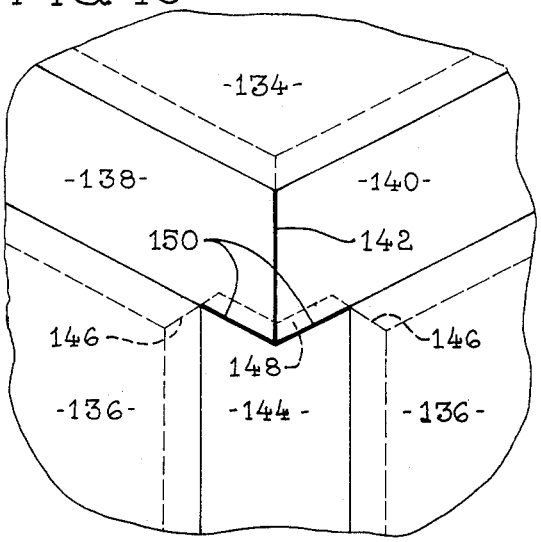

In FIGS. 16 through 20 the flow of water on the structure is generally toward the bottom of the figure. In FIG. 16 one roof panel 134 joins two wall panels 136 in the simplest vertex configuration. The intended permanence and weathertightness of the structure generally dictate the configuration of the vertex joint. The abutting connectors 138 and 140 are solvent welded or otherwise sealed at 142. The vertical connector 144 is mitered at 146 to accommodate the connectors 138 and 140, however the cap 148 of connector 144 is extended to fit into a slot at 150 cut into connectors 138 and 140. The plastic material for such connectors is typically sufficiently flexible to allow tucking under the caps of the other connectors. The vertex joint shown in FIG. 16, is intermediate in weathertightness and permanence.

Figure 17:
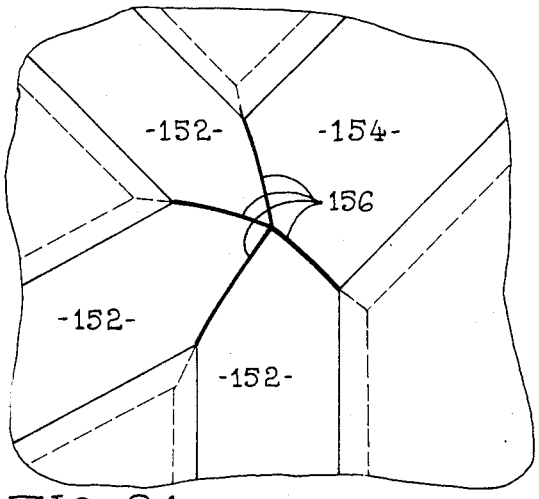

A less complicated vertex is illustrated in FIG. 17 wherein three 144° connectors 152 join one 108° connector 154 in a purely mitered configuration. No undercutting or slotting is required, the joints 156 merely being solvent welded, caulked, heat welded, covered with tape or left exposed. Such a construction is least permanent and weathertight, however, it is sufficient and least expensive in labor cost for temporary and emergency shelter. The simplest method to miter the ends of the edge connectors, if not done prior to assembly during manufacture of the components, is to utilize printed paper templates or patterns supplied with the instructions for assembly of the structures. Paper templates can also be utilized to trim the connectors for the vextices illustrated in FIGS. 16 and 18 through 20.

Figure 18:
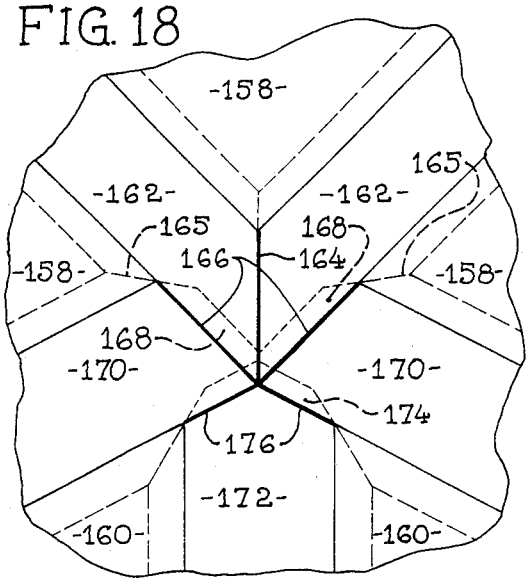
FIGS. 16 through 20 illustrate a variety of vertex joints among the connectors and panels; and, FIG. 21 is a partial cutaway view of a ground anchor and cable through a connector.

FIG. 18 illustrates a more complicated vertex joint wherein three roof panels 158 and two wall panels 160 join with 144° connectors. The upper connectors 162 between the roof panels 158 are mitered at 164 and 165 and slotted at 166 to accept the extended caps 168 of the connectors 170 in turn between the roof panels 158 and wall panels 160. The connector 172, between the wall panels 160, is trimmed to fit the extended cap 174 thereof into slots at 176 in the connectors 170. Printed templates included with the assembly instructions again may be advantageously utilized to field trim the ends of the individual connectors. During assembly the connectors at the vertex may be solvent welded or joined and sealed as noted above.

Figure 19:
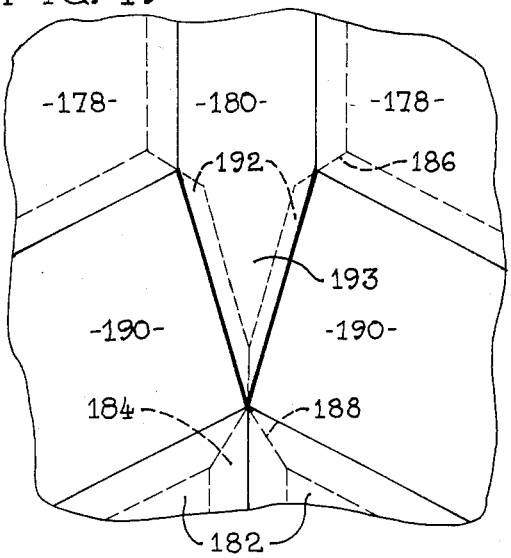
Figure 20:
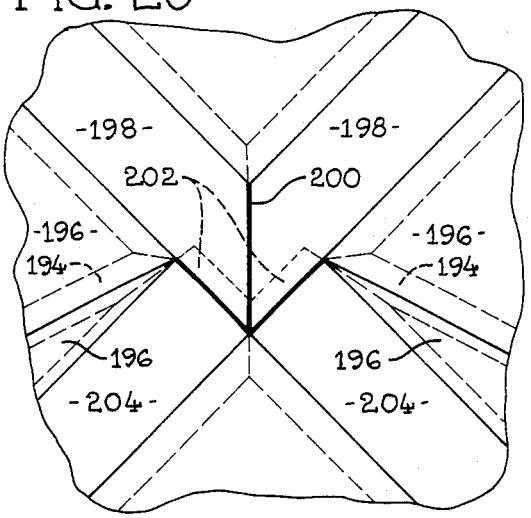

FIGS. 19 and 20 illustrate other common vertices encountered with the dome modules disclosed above, that include concave wall sections or roof sections. In FIG. 19 two roof panels 178 are joined by a 144° connector 180 and two wall panels 182 by a 144° connector 184 hidden therebehind because the wall panels 182 form a concave portion of the exterior wall. In FIG. 19 a third option for treating the juncture of connectors at a vertex is illustrated. The 144° connectors 180 and 184 are trimmed along the lines 186 and 188 to permit the 108° connectors 190 to fit therebetween with the 108° connector caps extended at 192 and tucked under the extended cap 193 of connector 180. The extended cap 193 is softened and bent down over the extended caps at 192.

FIG. 20 illustrates a vertex for the extended module of FIGS. 13 and 14 where six roof panels are joined together by 144° connectors, two of which 194 are hidden by the pairs of depressed roof panels 196 forming concave roof sections. The upper connectors 198 are mitered at 200 as above and slotted to permit the extended caps 202 of the lower connectors 204 to be fitted under the caps of the upper connectors.

Figure 21:
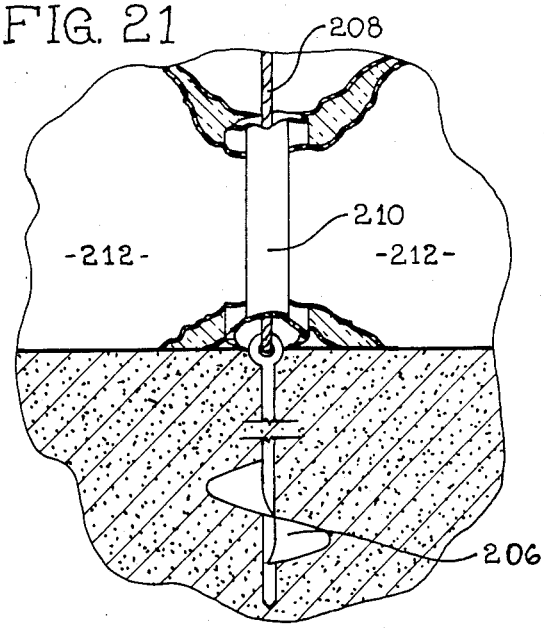

In FIG. 21 a screw auger 206 attached to a cable 208 is shown as a means of fastening a dome to the ground in situations where the foundation disclosed above is not included. The cable is passed through the substantially vertical hollow connectors 210 of the walls 212 and through the vertices and roof connectors as the dome is assembled. For very light domes or domes assembled from the top down, the augers can be screwed into the soil as the complete dome is lowered into place. Or, alternatively, a portion of the connector cap can be removed to expose a turnbuckle inside the connector and attached to the cable. The portion of the cap removed can be solvent welded into place after the turnbuckle is adjusted to tighten the dome to the ground. The cables pass over the dome through the hollow connectors and vertices to create a hidden tension means retaining the dome to the ground despite high wind loads or earthquakes. As another alternative, the cables can be clipped to the tops of the vertical wall connectors 210 before the roof is assembled thereon.

Typically, panel thickness will vary with the application and size of the structures. One-half to one inch thick panels are preferable for small disaster relief structures in moderate climates. Four and one-half inch thick panels are preferable for primary housing in cold climates and also allow use of standard window and door frames.

As may be noted from the following table the panel widths determine the module floor space. The various widths provide convenient room size units as best illustrated in FIG. 2.

| Panel Width | Max Wall Ht. | Min. Wall Ht. | Peak Ht. | Max Dia. | Approx. Floor Area | Rhombus Edge Length |
|---|---|---|---|---|---|---|
| 2 ft. | 8 ft. | 7 ft. | 10 ft. | 6.5 | 30 sq. ft. | 2.236 ft. |
| 3 ft. | 8 ft. | 6.5 ft. | 11 ft. | 9.7 | 70 sq. ft. | 3.354 ft. |
| 4 ft. | 8 ft. | 6 ft. | 12 ft. | 12.9 | 125 sq. ft. | 4.472 ft. |
| 5 ft. | 8 ft. | 5.5 ft. | 13 ft. | 16.2 | 200 sq. ft. | 5.590 ft. |
| 6 ft. | 8 ft. | 5 ft. | 14 ft. | 19.4 | 285 sq. ft. | 6.708 ft. |

The incorporation of the permanent peripheral foundation adds 42–48 inches to the vertical wall panels to meet the typical building code.

I claim:

1. An integrated panel and connector system for modified elongated triacontahedral dome structures comprising in combination foam core rigid plastic faced panels, the cores of the panels recessed along the edges or the panels to form channelled panel edges with the extended panel facings, 144° dihedral angle edge connectors adapted to join two panels together along adjacent panel edges, the sides of said edge connectors spaced apart at 144° relative to each other and sized to engage said channelled panel edges between said extended panel facings, and, wherein at least two of said panels are rhombic roof panels, at least two of said panels are modified rhombic roof panels with two parallel edges slightly elongated relative to the other two edges and at least two of said panels are wall panels with two parallel edges more than twice the length of the edge joining the parallel edges together.

2. The integrated panel and connector system of claim 1 including 108° dihedral angle edge connectors adapted to join two panels together along adjacent panel edges.

3. The integrated panel and connector system of claim 1 including 180° dihedral angle edge connectors adapted to join two panels together along adjacent panel edges.

4. The integrated panel and connector system of claim 1 including means on said edge connectors in combination with said extended panel facings to retain assembled panels and connectors together.

5. The integrated panel and connector system of claim 1 wherein the edge connectors are relieved to provide exposed connector surfaces flush with said panel facings.

6. Nestable modified elongated triacontahedral dome structures with vertical wall panels comprising at least two modified triacontahedral domes, at least one of said domes having at least two adjacent wall panels forming a concave portion of the exterior wall of said one dome, said two adjacent wall panels forming a dihedral angle of 144° therebetween, and, wherein at least two panels are rhombic roof panels, at least two panels are modified rhombic roof panels with two parallel edges slightly elongated relative to the other two edges and at least two panels are wall panels with two parallel edges more than twice the length of the edge joining the parallel edges together.

7. The nestable modified elongated triacontahedral dome structures of claim 6 wherein the two adjacent wall panels forming the exterior concavity each form a 108° dihedral angle with the wall panels next adjacent to each.

8. The nestable modified elongated triacontahedral dome structures of claim 6 wherein at least some of the above ground vertical wall panels extend below grade to form an integrated foundation wall for the dome structures.

9. The nestable modified elongated triacontahedral dome structures of claim 6 wherein the two exterior wall panels forming the concavity of one dome nest against two exterior wall panels of a second modified triacontahedral dome.

10. The nestable modified elongated triacontahedral dome structures of claim 6 wherein the panels, roof and wall of the structures are hard surfaced, said hard surfaces extended at the panel edges to form channels with the panel cores and including edge connectors adapted to engage the panel edge channels.

11. The nestable modified elongated triacontahedral dome structures of claim 10 wherein the majority of the edge connectors join the panels at dihedral angles of 144°.

12. The nestable modified elongated triacontahedral dome structures of claim 11 wherein at least some of said edge connectors join panels at dihedral angles of 108°.

13. A modified elongated triacontahedral dome structure comprising two inner concentric rings of five rhombic panels each and all of equal size, said rhombic panels edge connected together to form a convex roof about the central peak of the dome, a third concentric ring of rhombic roof panels about the two inner rings and edge connected to the outer ring of the two inner rings, at least two of the rhombic panels of the third ring depressed to form a concave roof segment having a 144° dihedral angle between the two depressed rhombic roof panels of the third ring, said two depressed rhombic roof panels extended along two parallel edges to meet the edge connections to adjacent roof panels.

14. The triacontahedral dome structure of claim 13 including a fourth ring of rhombic roof panels edge connected to the third ring and edge connected to a plurality of vertical wall panels forming the side walls of the dome.

15. The triacontahedral dome structure of claim 14 wherein the edge connectors join the depressed rhombic roof panels to other roof panels at 144° dihedral angles.

16. The triacontahedral dome structure of claim 14 including at least two vertical wall panels joined at a 144° dihedral angle to form a concavity in the exterior wall of the dome structure.

17. The triacontahedral dome structure of claim 13 including panel edge extensions adapted to join at least some of the panels to edge connectors.

18. The triacontahedral dome structure of claim 13 wherein said panels are hard surfaced, said hard surfaces extended at the panel edges to form channels with the panel cores, and edge connectors adapted to engage the panel edge channels, said edge connectors including caps to provide flush surfaces at the panel and connector junctures.

19. The triacontahedral dome structure of claim 18 wherein the majority of the edge connectors join the panels at dihedral angles of 144°.

20. The triacontahedral dome structure of claim 19 wherein at least some of said edge connectors join panels at dihedral angles of 108°.

* * * * *